US008414094B2

(12) United States Patent
Chi et al.

(10) Patent No.: US 8,414,094 B2
(45) Date of Patent: Apr. 9, 2013

(54) DRAWER SYSTEM SLIDE ASSEMBLIES AND CLOSURE MECHANISMS

(75) Inventors: Quinn Chi, Long Beach, CA (US); Saul Gutnik, Irvine, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 835 days.

(21) Appl. No.: 12/362,362

(22) Filed: Jan. 29, 2009

(65) Prior Publication Data

US 2009/0195131 A1 Aug. 6, 2009

Related U.S. Application Data

(60) Provisional application No. 61/063,474, filed on Feb. 4, 2008.

(51) Int. Cl.
*A47B 95/00* (2006.01)
*A47B 88/00* (2006.01)

(52) U.S. Cl.
USPC ..... 312/333; 312/334.6

(58) Field of Classification Search ..... 312/333, 312/334.6, 334.1, 334.9, 334.11, 334.14, 312/334.15, 334.17, 334.25, 334.26, 334.27, 312/334.33, 334.38, 334.44, 334.45, 334.47, 312/319.1; 384/21, 18
See application file for complete search history.

(56) References Cited

U.S. PATENT DOCUMENTS 3,451,730 A * 6/1969 Thomas et al. ..... 384/18
4,653,821 A 3/1987 Faust
4,752,142 A * 6/1988 Jackson et al. ..... 384/18
4,752,143 A 6/1988 Lautenschlager, Jr.
5,207,781 A 5/1993 Rock
(Continued)

FOREIGN PATENT DOCUMENTS

DE 31 27 701 A1 2/1983
DE 33 23 195 A1 1/1985
(Continued)

OTHER PUBLICATIONS

PCT International Search Report and Written Opinion of the International Searching Authority (PCT/US2009/000591) (Jan. 6, 2010) (10—pgs).

(Continued)

*Primary Examiner* — Janet M Wilkens
*Assistant Examiner* — Andrew Roersma
(74) *Attorney, Agent, or Firm* — Pillsbury Winthrop Shaw Pittman LLP

(57) ABSTRACT

A self-closing drawer slide system includes first and second slide members and a self-closing mechanism which, in turn, includes a housing coupled to the first slide member, a carriage slidably coupled to the housing, and a spring coupled between the housing and the carriage. The carriage has an engagement area that selectively receives a cam/tab extending from the second slide member. As the drawer is pulled open, the carriage disengages from the cam/tab as it rotates and is locked in place. As the drawer returns, the carriage again engages the cam/tab, unlocks, and is pulled toward a drawer-closed position by the spring. The system may also include an intermediate member, with respective sets of three balls disposed between the intermediate and first and second slide members such that respective centers of the balls define corners of an obtuse triangle. The self-closing mechanism may also include a damper.

18 Claims, 17 Drawing Sheets

U.S. PATENT DOCUMENTS

| | | | | |
|---|---|---|---|---|
| 5,240,318 | A * | 8/1993 | Schroder et al. | 312/319.1 |
| 5,474,375 | A * | 12/1995 | Hollenstein et al. | 312/319.1 |
| 5,570,943 | A * | 11/1996 | Schroder et al. | 312/334.11 |
| 5,775,788 | A * | 7/1998 | Sasse et al. | 312/334.38 |
| 5,882,100 | A | 3/1999 | Rock | |
| 6,132,020 | A * | 10/2000 | Schael et al. | 312/334.1 |
| 6,378,968 | B1 * | 4/2002 | Weng | 312/334.11 |
| 6,846,053 | B2 * | 1/2005 | Salice | 312/334.14 |
| 7,244,005 | B1 * | 7/2007 | Lu | 312/333 |
| 7,374,260 | B2 * | 5/2008 | Lu | 312/333 |
| 7,481,505 | B2 * | 1/2009 | Orita | 312/333 |
| 2002/0011766 | A1 | 1/2002 | Kim et al. | |
| 2003/0090186 | A1 | 5/2003 | Weng | |
| 2005/0093406 | A1 * | 5/2005 | Yang | 312/333 |
| 2005/0184629 | A1 * | 8/2005 | Yang | 312/334.4 |
| 2007/0132346 | A1 * | 6/2007 | Huang | 312/333 |
| 2007/0278917 | A1 * | 12/2007 | Yang | 312/330.1 |
| 2007/0278919 | A1 | 12/2007 | Lu | |
| 2009/0045710 | A1 * | 2/2009 | Compagnucci | 312/333 |

FOREIGN PATENT DOCUMENTS

| | | | |
|---|---|---|---|
| DE | 35 35 332 | A1 | 4/1987 |
| DE | 90 07 365.7 | | 8/1991 |
| DE | 195 11 999 | A1 | 10/1996 |
| DE | 20 2007 007 959 | U1 | 9/2007 |
| EP | 0 226 389 | A2 | 6/1987 |
| EP | 0 720 824 | A2 | 7/1996 |
| EP | 1 188 397 | A1 | 3/2002 |
| EP | 1 277 422 | A1 | 1/2003 |
| GB | 2 061 705 | A | 5/1981 |
| GB | 2 415 606 | A | 1/2006 |
| WO | WO 2007.108601 | A1 | 9/2007 |
| WO | WO 2007/111424 | A1 | 10/2007 |

OTHER PUBLICATIONS

Invitation to Pay Additional Fees/Partial International Search, (PCT/US2009/000591), (4—pgs).

* cited by examiner

3/4 Extension

Full Extension

DRAWER SYSTEM SLIDE ASSEMBLIES AND CLOSURE MECHANISMS

RELATED APPLICATION DATA

This application claims priority from Provisional Application Ser. No. 61/063,474, filed Feb. 4, 2008, which is incorporated herein by reference in its entirety.

TECHNICAL FIELD

Aspects of the present invention relate generally to drawer systems and, more specifically, to drawer slides and slide profiles, as well as closure mechanisms including self-closing features.

BACKGROUND

The conventional drawer slide includes a drawer member and a cabinet member, and may include an intermediate member as well as a conventional self-closing mechanism. Typically, the drawer slide is mounted between a side of a drawer and a sidewall of a cabinet, with the drawer member affixed to the drawer, and the cabinet member affixed to the cabinet. With only a drawer member and a cabinet member, the drawer slide provides a maximum of ¾ extension (or travel). However, when an intermediate member is employed, the drawer slide provides full extension.

The drawer slide facilitates the opening and closing of a drawer in a cabinet. Thus, slides are used with drawers and trays to allow easy access to stored articles. In storage applications, where heavy articles may be stored, the slide members are subjected to very high forces, especially when the drawer is fully loaded and the slide is in the extended position. Under these high load conditions, the members in a conventional slide assembly will twist and bend, which eventually leads to fatigue failure after repeated opening and closing cycles. The member that is most susceptible to this kind of failure is the intermediate member because it encounters the highest levels of stress. In addition, although conventional slide assemblies employ one or more ball race tracks to keep the members together, they often fail to provide for optimum lateral stability.

The conventional self closing mechanism may include a slide component slidably mounted on, e.g., the cabinet member of the drawer slide and spring biased in the closing direction of the drawer slide, and an engagement component fixedly mounted on, e.g., the drawer member of the drawer slide. When the drawer slide is in the closed position, the engagement component is fully engaged with the slide component. As the drawer slide is pulled open, the engagement component pulls the slide component in the opening direction of the drawer slide against the spring force. When the slide component reaches a certain point, it locks into position and releases the engagement component. The slide component remains in the locked position until it is released by the engagement component when the drawer slide is pushed back to a closed position. Once it is released, the spring-biased slide component, now back in full engagement with the engagement component, pulls the engagement component in the closing direction of the drawer slide, thereby pulling the drawer slide to a closed position.

The conventional drawer slide/self-closing mechanism system has various drawbacks. For example, it is known that the conventional drawer slide is designed so that it can be expanded to a maximum width before it can no longer function properly. However, depending on the width of the drawer slide and the sidespace within which it is to be mounted (i.e., the space between the side of the drawer and the sidewall of the cabinet), certain configurations may be called for wherein, although the drawer slide remains functional, the self-closing mechanism does not because the engagement component can no longer reliably engage with the slide component.

Another drawback of the conventional self-closing mechanism is that, when mounted within the cabinet member of a drawer slide, it allows the intermediate member to slam against it. Excessive and/or repeated slamming can damage the self-closing mechanism and cause it to malfunction. In addition, the conventional self-closing mechanism typically has a high profile such that, when it is mounted within the cabinet member of a drawer slide, it does not allow the intermediate member and/or the drawer member to slide over it. This results in a decreased sliding length with respect to the drawer and intermediate members, which, in turn, lowers the load-bearing capacity of the drawer system.

DETAILED DESCRIPTION

Embodiments of the present invention are directed to slide assemblies and profiles, as well as closure mechanisms including self-closing and/or damping devices as described in more detail hereinbelow.

Figure 1:
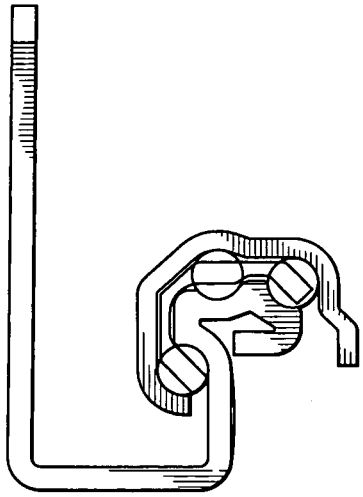
FIG. 1 is a slide assembly in accordance with an embodiment of the present invention.
Figure 2:
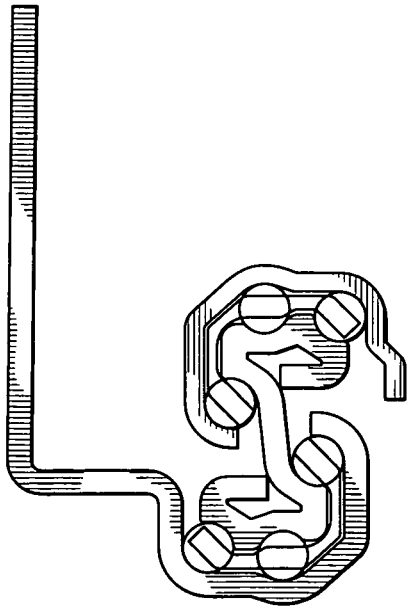
FIG. 2 is a slide assembly in accordance with another embodiment of the present invention.

FIG. 1 shows a ¾ extension, and FIG. 2 shows a full extension drawer slide assembly in accordance with embodiments of the present invention. It is to be noted that, although the following description is presented in connection with a full-extension drawer slide assembly, such description is by way of illustration, and not limitation. As such, the principles discussed hereinbelow in connection with the full-extension configuration shown in FIG. 3 are equally applicable to various other embodiments of the present invention, including, but not limited to, the ¾ embodiment shown in FIG. 1.

Figure 3:
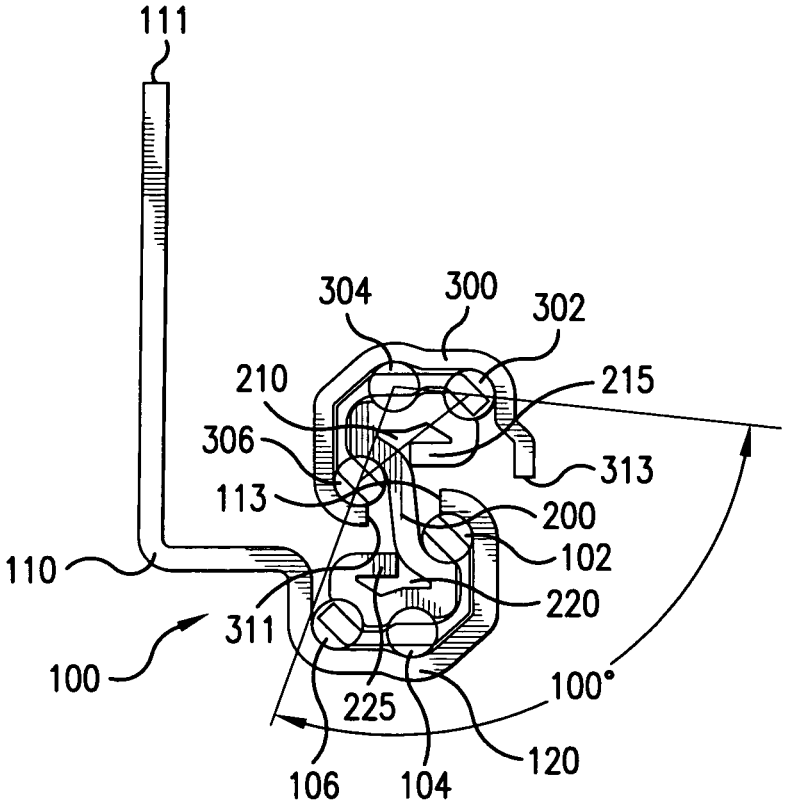
FIG. 3 is a detailed illustration of the embodiment shown in FIG. 2.

As shown in FIG. 3, a full-extension drawer slide assembly includes three slide members: (1) an outer (or cabinet) slide member 100; (2) an intermediate slide member 200; and (3) an inner (or drawer) slide member 300. While the inner slide member 300 is a singular structure that constitutes an upper rail member, the outer slide member 100 comprises two portions: a L-shaped connection portion 110 that is configured for connection to a stationary piece of furniture (e.g., the interior wall of a cabinet), and a lower rail member 120 that is integral with the connection portion 110. The drawer slide member 300 has extreme edges 311 and 313. Similarly, the outer slide member 100 has extreme edges 111 and 113.

The intermediate member 200 interfaces with the drawer slide member 300 via a first set of balls (e.g., ball bearings) 302, 304, 306 that are disposed in raceways formed between the intermediate member 200 and the inner surface of the drawer slide member 300. Similarly, the intermediate member 200 interfaces with the lower rail member 120 via a second set of balls (e.g., ball bearings) 102, 104, 106 that are disposed in raceways formed between the intermediate member 200 and the inner surface of the lower rail member 120. All of the balls are supported by a cage, which may be made of, e.g., plastic or metal, to keep the balls evenly spaced as the slide members are extended and retracted.

In each set mentioned above, the 3 balls are positioned such that, when viewed from the cross-sectional perspective shown in FIG. 3, lines drawn through the respective centers of the three balls form an obtuse triangle having one angle that is approximately 100°, with the remaining two angles measuring approximately 30° and 50°, respectively. In embodiments of the invention, this may translate into a configuration in which the respective contact points between each of the balls and the intermediate member 200 form an obtuse angle that is approximately 101°.

The raceways-forming area of the intermediate member 200 has a top groove 210 which is open in a generally downward direction and a bottom groove 220 which is open in a generally upward direction. The intermediate member 200 also has a top inwardly-bent arm 215 which may be disposed substantially horizontally, and occupies a small portion of the top groove 210. Similarly, the intermediate member 200 includes a bottom inwardly-bent arm 225 which may be disposed substantially horizontally, and occupies a small portion of the bottom groove 220.

Figure 4:
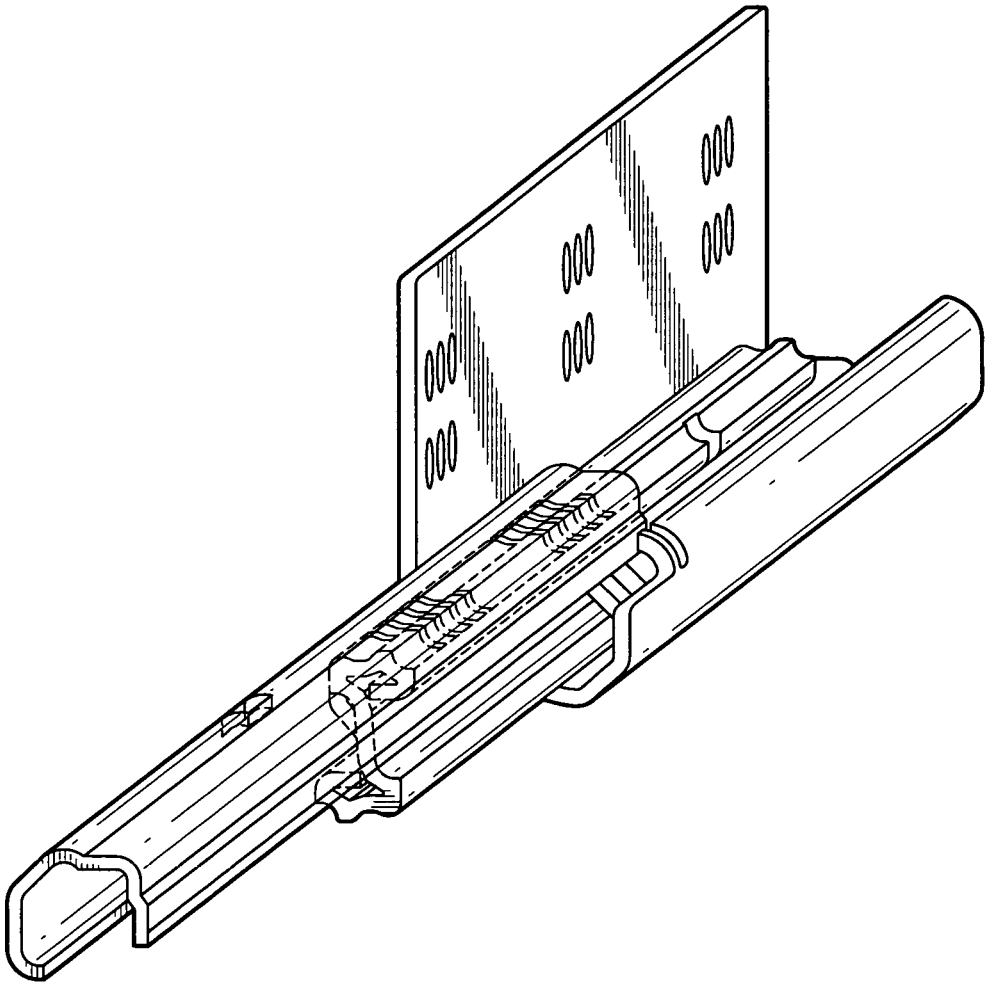
FIG. 4 is a perspective view of the embodiment shown in FIG. 2.

As noted previously, embodiments of the slide assembly may take on various configurations. Thus, for example, the partial extension slide shown in FIG. 1 typically provides ¾ extension (e.g., a 16-inch long slide will provide about 12 inches of travel) and requires only 2 members: a drawer slide member and a cabinet slide member that, at its free end, is integral with a raceways-forming area to accept a set of ball bearings. In contrast, as shown in FIGS. 2 and 3, to achieve full extension, 3 slide members are required. See also FIG. 4 for a perspective view of the full-extension slide assembly.

Regardless of the specific configuration, in the extended position and with the drawer fully loaded, the slide members of the slide assembly are subjected to very high forces. Under these high load conditions, the members may twist and/or bend which, if unchecked, will eventually lead to fatigue failure after repeated opening and closing cycles. In this regard, and with reference to the illustrative example of a full-extension, 3-member assembly, the member that is most susceptible to the above-mentioned failure is the intermediate member 200, as this is the member that encounters the highest levels of stress.

To this end, embodiments of the invention include an intermediate member that has a high moment of inertia, thereby imbuing the member with superior structural rigidity in the vertical direction. For example, as shown in FIG. 3, the intermediate member 200 may generally have an I-Beam configuration, with the vertical portion of the "I" being generally in the shape of a reversed "S". In this way, the raceways of the intermediate member 200 can be positioned so as to transfer the load of the drawer in the vertical direction, where the intermediate member is strongest. Thus, for example, the balls 104, 304 may act to transfer the load of the drawer vertically through the intermediate member 200, while the balls 102, 106 and the balls 302, 306 serve to keep the members together and minimize twisting of the slides. In addition, being substantially larger than 90°, the obtuse angle formed by the balls (e.g., 302, 304, 306) provides superior lateral stability as compared to conventional assemblies.

Figure 5:
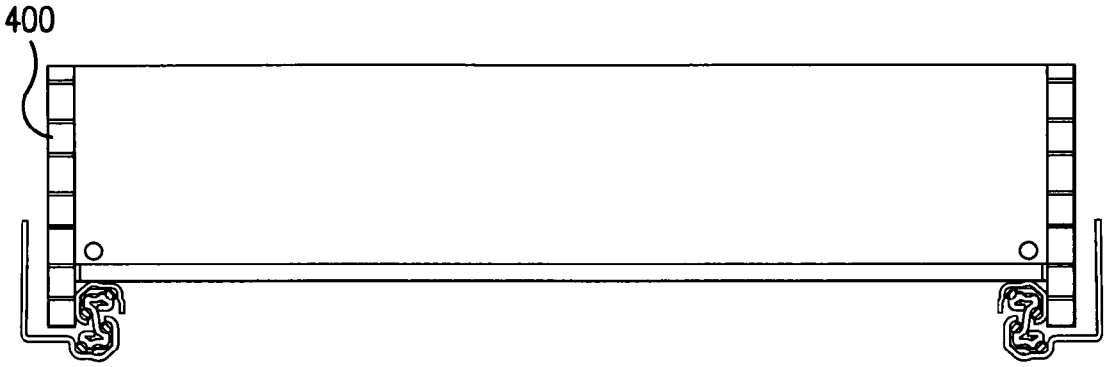
FIG. 5 shows a slide assembly installed in accordance with an embodiment of the present invention.

As shown in FIG. 5, embodiments of the invention provide for a slide assembly that may be mounted differently than traditional slides. Specifically, the cabinet member 100 may be mounted to the cabinet through a vertical web 400, with the drawer being supported by the drawer member 300. One benefit of this kind of mounting configuration is that it shrouds the metal slide member when the drawer is in the open position. In many appliance applications, including, e.g., those used in high-end kitchens, this is a desirable feature because it allows the drawer to hide the hardware.

In addition, with the above construction, the drawer typically can be easily removed and installed onto the slide. Specifically, the bottom of the drawer, which sits on top of the drawer member 300, drags across the top of the drawer member as the drawer is removed and installed. The top of the drawer member, having a curved surface, comes into minimal contact with the bottom of the drawer. Since there is less friction between the drawer and the drawer member, it takes less effort to remove and install the drawer onto the drawer member.

For all of the above-mentioned embodiments, the drawer slide members may be made of steel, and may be fabricated by an extrusion process or a roll form process, among others.

Embodiments of the invention are also directed to closure mechanisms which may be employed in conjunction with one or more of the slide assemblies discussed above. In one embodiment, shown in FIG. 6, the closure mechanism 500 includes a housing 510. For ease of manufacturing, the housing may be a two-piece housing assembly, where mating left-hand side 512 and right-hand side 514 pieces are coupled to one another to form the housing 510. It is noted that the descriptors "left-hand side" and "right-hand side" are used herein for ease of reference only, and do not restrict the structure, means for manufacturing, or operation of, or otherwise limit, embodiments of the invention. In addition, in embodiments of the invention, the housing 510 may be a unitary member.

Figure 7:
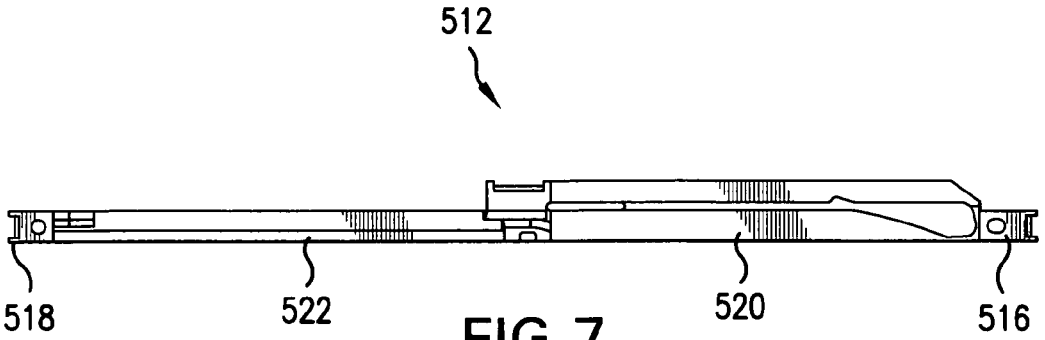
FIG. 7 is a sectional view of the housing of the closure mechanism shown in FIG. 6.
Figure 8:
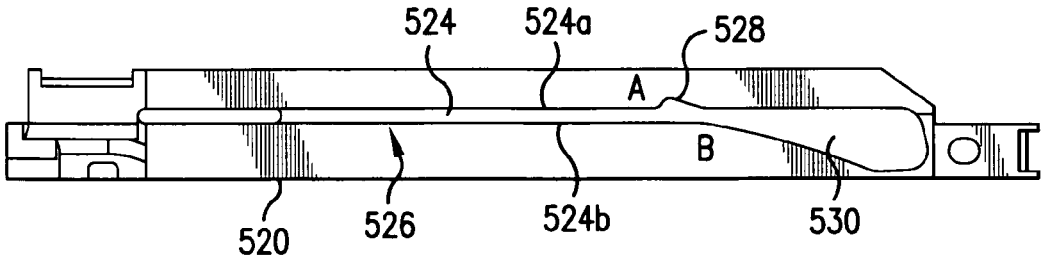
FIG. 8 is a sectional view of a front section of the housing of the closure mechanism shown in FIG. 6.

FIG. 7 shows a plan view of one side of the housing, e.g., the left-hand side 512, having a longitudinal front end 516, a longitudinal rear end 518, a front section 520, and a rear section 522. As shown in FIG. 8, the front section 520 includes a carriage guide groove 524 having a top edge 524*a* and a bottom edge 524*b*. Towards its rear, the carriage guide groove 524 includes a rectilinear portion 526, wherein the top edge 524*a* is parallel to the bottom edge 524*b*. At a position "A" towards its front portion, the carriage guide groove's top edge 524*a* has a substantially triangular housing notch 528, and, at a position "B", the bottom edge 524*b* diverges downwards from the rectilinear top edge 524*a* to form a rotation zone 530. In embodiments of the invention, the transition from the rectilinear portion 526 to the rotation zone 530 is arcuate, so as to form a smooth area of divergence in/around position "B" in the bottom edge 524*b*.

Figure 6:
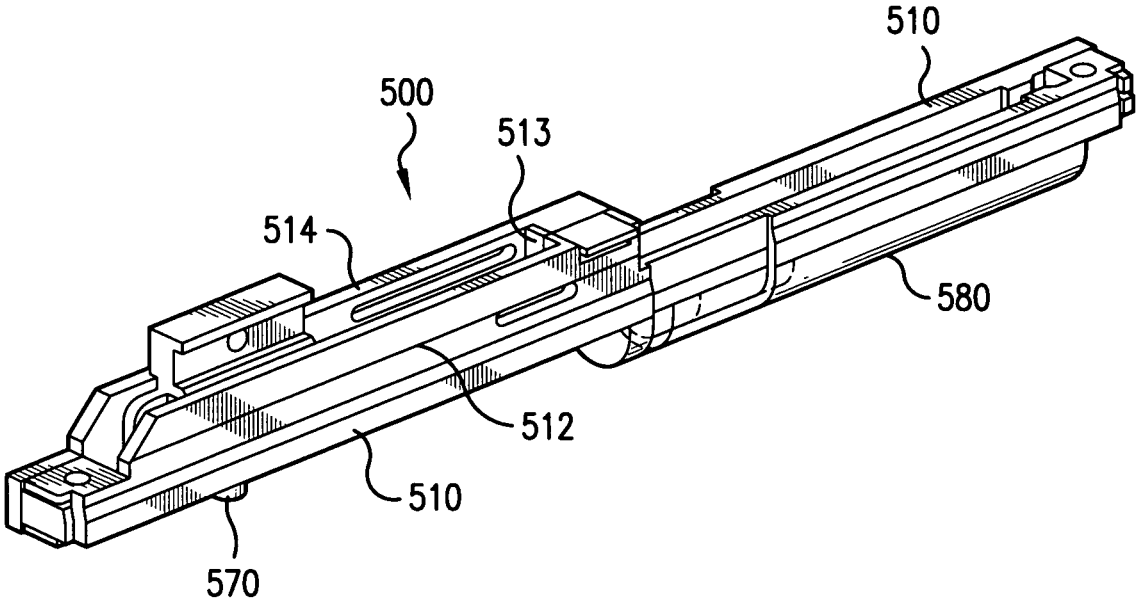
FIG. 6 is a perspective view of a closure mechanism and cam in accordance with an embodiment of the present invention.
Figure 9A:
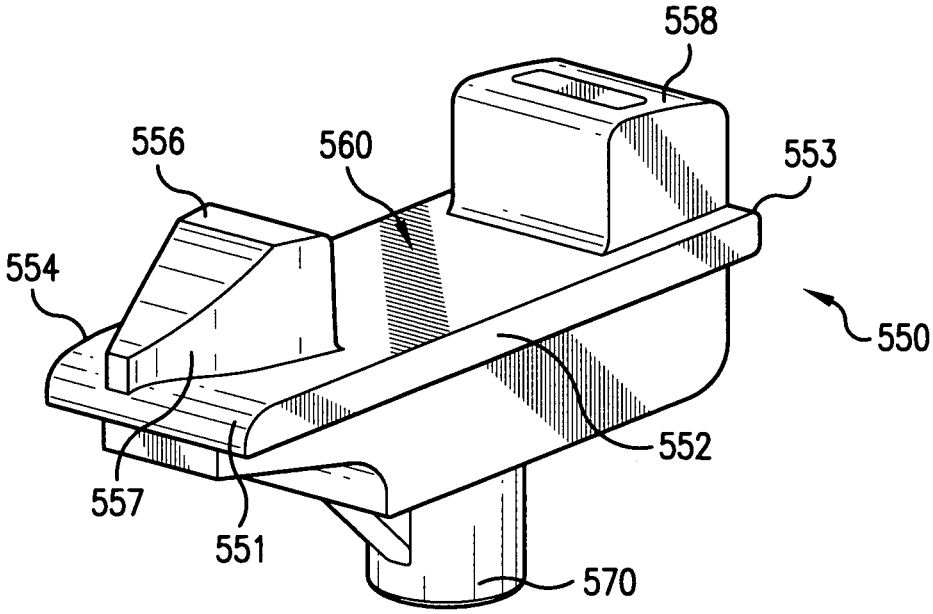
FIG. 9A shows a carriage member in accordance with an embodiment of the present invention.
Figure 9B:
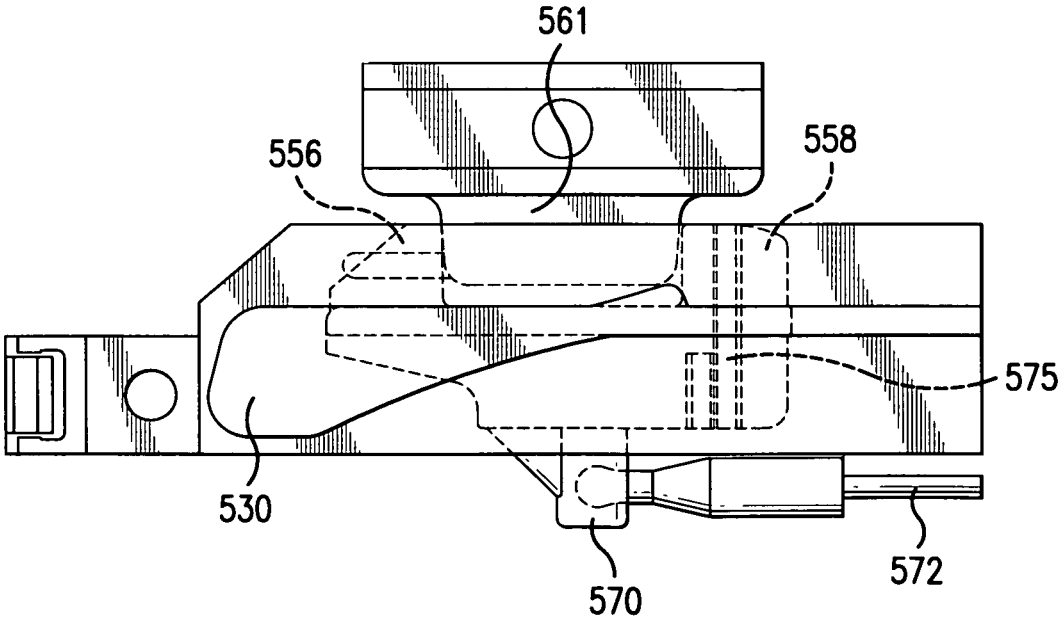
FIG. 9B shows a front section of the closure mechanism shown in FIG. 6, with a carriage member coupled to a damper rod and engaged with a cam.

FIG. 9A shows a carriage or "dog" 550 having a left-hand side guide ledge 552 and an opposing right-hand side ledge 554. Again, the descriptors "left-hand side" and "right-hand side" are used herein for ease of reference only. With reference to FIGS. 6, 9A, and 9B, on its top side, the carriage 550 includes a front tooth 556 and a rear tooth 558 which, together, define an engagement area (or mouth) 560 for engaging with a cam 561. On its bottom side, the carriage 550 includes a first catch 570 for receiving and holding therein the front portion of a rod 572 which, at its rear end, slides within a damping cylinder (i.e., damper) 580. The damping cylinder 580 may be, e.g., of a fluid or air type, and may be connected to an undersurface of the rear section 522 of the housing 510 (see FIG. 6).

On its rear side, the carriage 550 includes a second catch 575 for receiving and holding therein the front portion of a spring (not shown) whose rear portion is connected to the rear end 518 of the rear section 522. Thus, the spring is located between, and parallel to, the left-hand side 512 and right-hand side 514 pieces of the housing 510. With the above structure, the spring imparts a closing force on the carriage 550, tending to move the carriage towards the rear end 513 of the front section 520, and the damper imparts a damping force on the carriage. In embodiments of the invention, the spring may be, e.g., an extension type spring.

In the assembled housing 510, respective ones of the carriage guide ledges 552,554 are received within, and move longitudinally along, respective ones of the carriage guide grooves on the two sides 512, 514 of the housing. Thus, for example, the left-hand side ledge 552 may engage with the carriage guide groove 524 of the left-hand side piece 512, and the right-hand side ledge 554 may engage with a matching carriage guide groove on the inner surface of the right-hand side piece 514. In addition, the damper 580 generally has sufficient rating to dissipate the kinetic energy of a full payload moving at maximum speed, and the rod 572 is attached to the carriage 550 in such a way as to allow limited vertical and/or horizontal rotation of the carriage 550, generally following its longitudinal direction of travel.

In an illustrative embodiment of the invention, the closure mechanism 500 may be coupled to the cabinet member, and the cam 561 may be coupled to the drawer member. As shown, e.g., in FIG. 9B, both the mouth 560 and the cam 561 are substantially rectangular in shape. However, other geometries that facilitate engagement and disengagement between the carriage 550 and the cam 561 may be used and are within the scope of the invention herein.

In the illustrative embodiment mentioned above, the closure mechanism 500 may operate as follows: As the drawer is pulled open, the cam 561, which is coupled to, or integral with, the drawer member, and is resting inside mouth 560, pulls the carriage 550 forward, stretching out the spring, and extending the damper rod 572. When the front portion 551 of the carriage 550 reaches the rotation zone 530 in the front portion of the carriage guide groove 524, continued outward extension of the drawer (and, therefore, the drawer member having the cam 561 coupled thereto) causes the carriage to rotate downwards as it moves forward.

As the carriage 550 rotates forward, its front tooth 556 moves downward and releases the cam 561 to travel further with the drawer. The same rotational motion causes the rear ends 553 of the guide ledges 552, 554 to rotate and rise upwards, thereby engaging the matching housing notches 528 formed in the top edges 524*a* of the carriage guide grooves in the two sides 512, 514 of the housing. In this way, as the drawer is extended further outwardly, the carriage remains latched at the front end of the housing, counteracting the spring tension and positioned to readily re-engage the cam 561 when the drawer is pushed back inwardly.

When the drawer moves back, the cam 561 reaches the carriage 550 and pushes the rear tooth 558, causing it to rotate backwards which, in turn, causes the rear ends 553 of the guide ledges 552, 554 to disengage from the housing notches 528 and capture the cam 561 with the rising front tooth 556. Once the carriage is released from the notch, the spring pulls the carriage and, therefore, the drawer via the cam, inwards, toward the rear of the closure mechanism 500. At the same time, the damping cylinder 580 provides resistance to the drawer movement to slow it down to assure soft stopping at the end of travel. Once stopped, the cam remains inside the carriage's mouth so as to retain the drawer's closed position.

In this way, backward (i.e., inward) movement of the drawer is dampened, or cushioned, so as to avoid hard slamming of the drawer at the end of its closing stroke, while assuring that it not only comes to a complete closed position, but is also retained in this position against random creep. Typically, the retaining force is the minimum necessary, so as not to unnecessarily inhibit opening of the drawer.

It is noted that situations may arise in which the carriage is inadvertently released from the latched position while the drawer is in the open position. Here, a resetting feature will allow the closure mechanism to return to its normal operating mode. Specifically, at least one face 557 of the front tooth 556 may be tapered so as to form a ramp section at the front of the carriage. This allows the cam 561 to force the carriage to move laterally out of the way as the cam moves inwardly into the cabinet. This, in turn, causes the drawer member to be forced to the fully closed position, with the cam returning to its home position between the two teeth 556, 558, and ready to resume normal operation. In embodiments of the invention, in addition to the above-mentioned tapering of the front tooth, one or both side walls of the housing 510 may be thinned so as to allow improved lateral flexure of the wall(s) as the carriage moves out of the way of the inwardly-moving cam.

As noted previously, the above-described placement of the closure mechanism and cam are illustrative only, and other configurations may be used. Thus, for example, the closure mechanism may be coupled to the drawer member, with the cam coupled to the cabinet member.

Figure 10A:
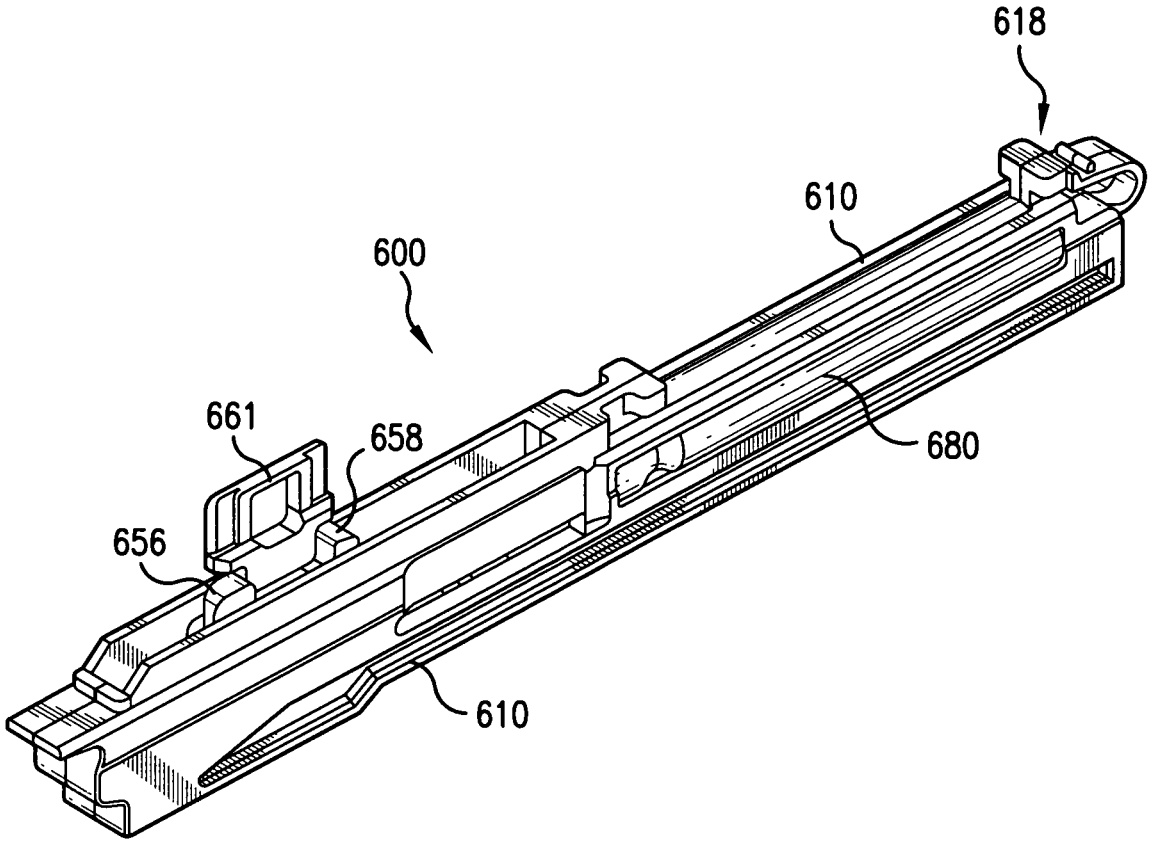
FIG. 10A is a perspective view of a closure mechanism and cam in accordance with an embodiment of the present invention.

Similarly, in embodiments of the invention, the damper may be disposed towards a top side of the closure mechanism's housing, and the spring may be disposed towards a bottom side of the housing. In this regard, FIG. 10A shows a closure mechanism 600 includes a housing 610. As with previously-described embodiments, for ease of manufacturing, the housing 610 may be a two-piece housing assembly, where mating left-hand side and right-hand side pieces are coupled to one another to form the housing 610. In additional embodiments, the housing 610 may be a unitary member.

Figure 10B:
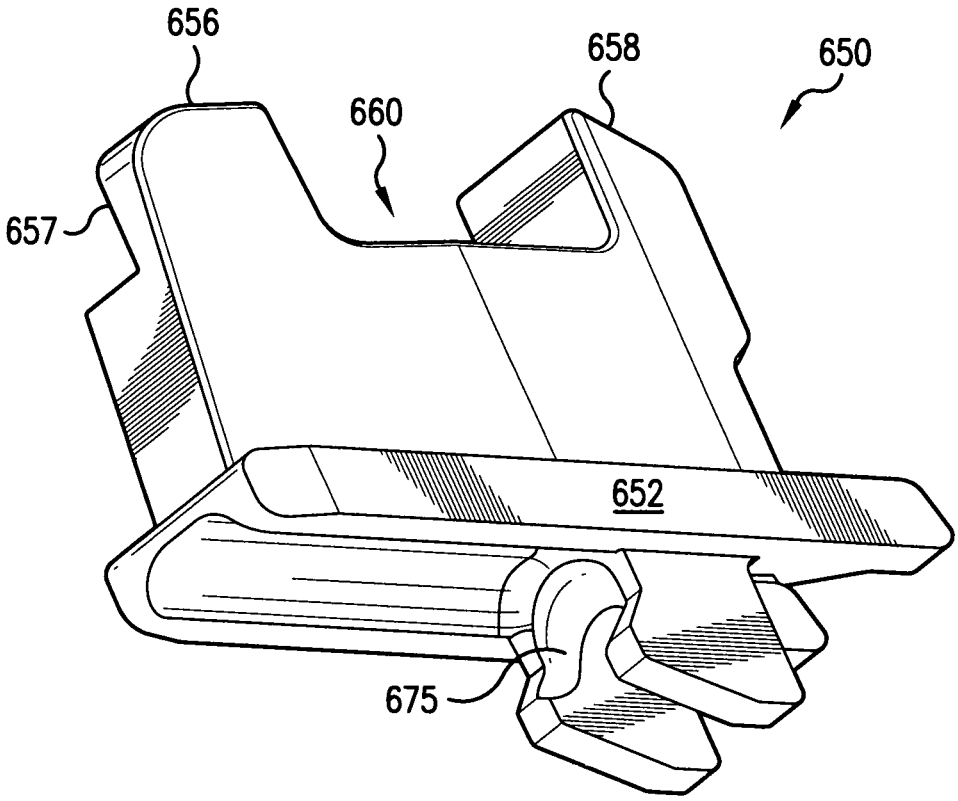
FIG. 10B shows a side perspective view of a carriage member in accordance with an embodiment of the present invention.
Figure 10C:
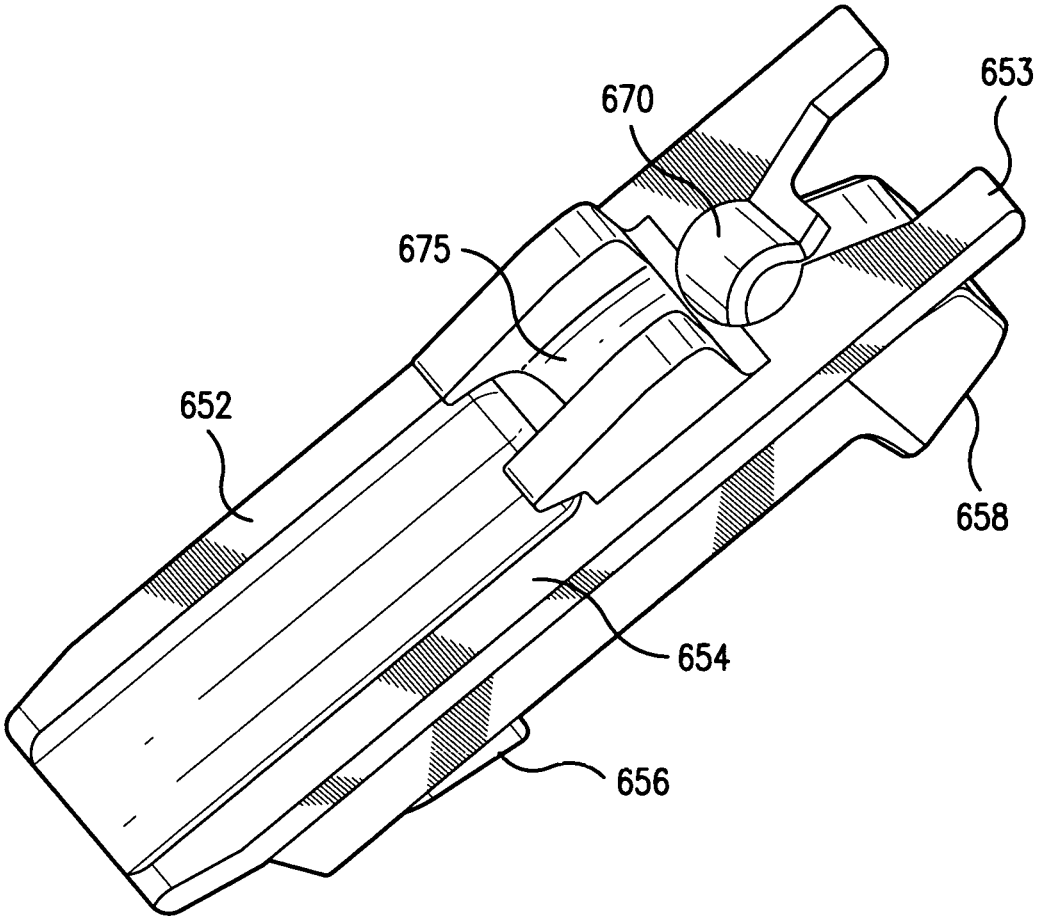
FIG. 10C shows a bottom perspective view of the carriage member shown in FIG. 10B.

FIGS. 10B and 10C show a carriage 650 having a left-hand side guide ledge 652, an opposing right-hand side ledge 654, a front tooth 656 having a tapered face 657 and a rear tooth 658 which, together, define a mouth 660 for engaging with a cam 661. On its bottom side, proximate its rear end 653, the carriage 650 includes a first catch 670 for receiving and holding therein the front portion of a rod (not shown) that slides within a damping cylinder (i.e., damper) 680. As noted previously, the damping cylinder 680 may be, e.g., of a fluid or air type, and may be connected to the rear end 618 of the housing 610.

Disposed adjacent, and somewhat below, the first catch 670, is a second catch 675 for receiving and holding therein the front portion of a spring (not shown) whose rear portion is connected to the rear end 618 of the housing 610, below the damping cylinder 680. Thus, both the damper 680 and the spring are located between, and parallel to, the left-hand side and right-hand side pieces of the housing 610, with the spring being disposed below the damper 680. As with the embodiments described previously, the spring imparts a closing force on the carriage 650, tending to move the carriage towards the rear end 618 of the housing 610, and the damper 680 imparts a damping force on the carriage. As noted, the damper 680 generally has sufficient rating to dissipate the kinetic energy of a full payload moving at maximum speed, and the rod is attached to the carriage 650 in such a way as to allow limited vertical and/or horizontal rotation of the carriage 650, generally following its longitudinal direction of travel.

In an alternative embodiment, the closure mechanism 700, shown in FIGS. 11-16, includes a housing 710, a carriage 750, and an extension spring 800 coupled between one end of the housing 710 and the carriage 750.

Figure 12:
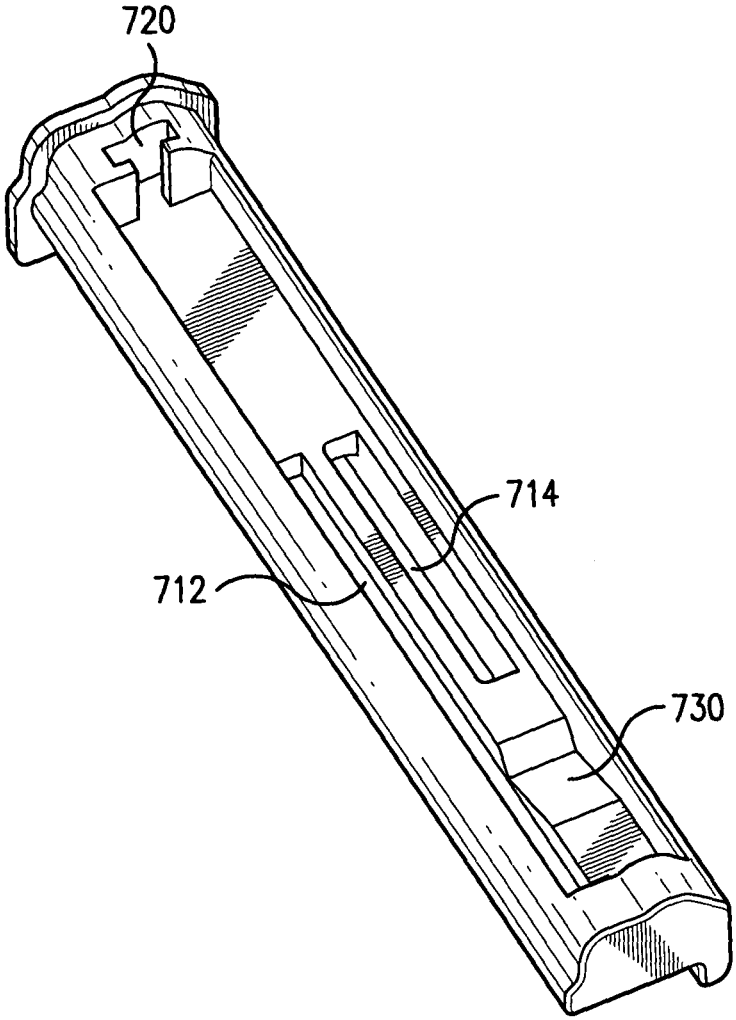
FIG. 12 is the perspective view shown in FIG. 11B, with the spring removed.

With reference to the bottom view shown in FIG. 12, the closure mechanism 700 includes a carriage guide channel 712 and a relief channel 714, both of which run longitudinally through different portions of the length of a horizontal base of the housing 710. The base of the housing also includes a substantially triangular-shaped recess 730 that provides a locking position along the carriage's direction of travel.

Figure 13A:
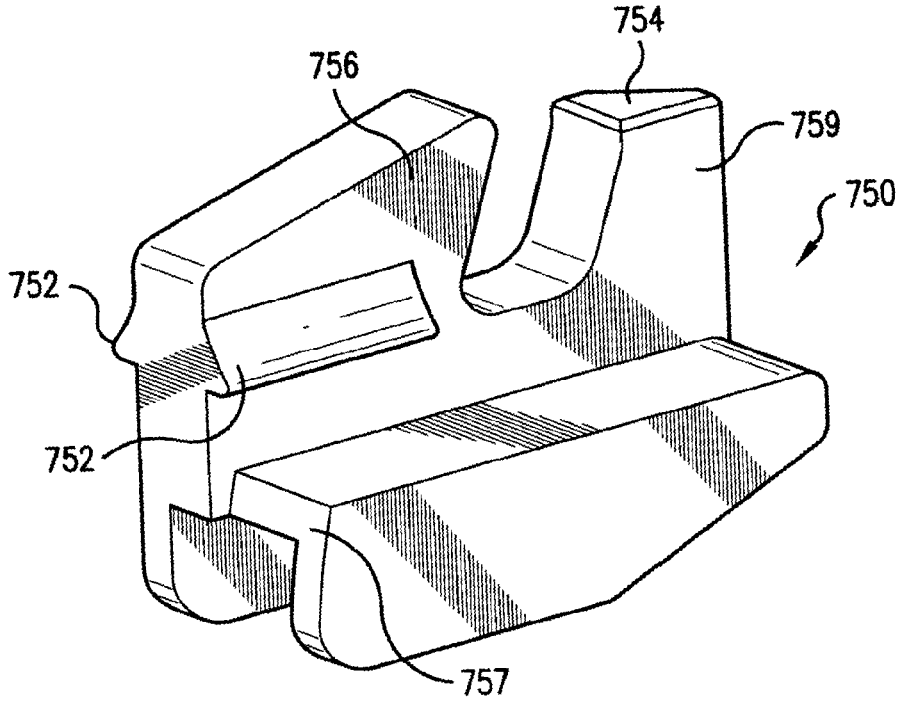
FIGS. 13A and 13B show views of a carriage member in accordance with an embodiment of the present invention.
Figure 13B:
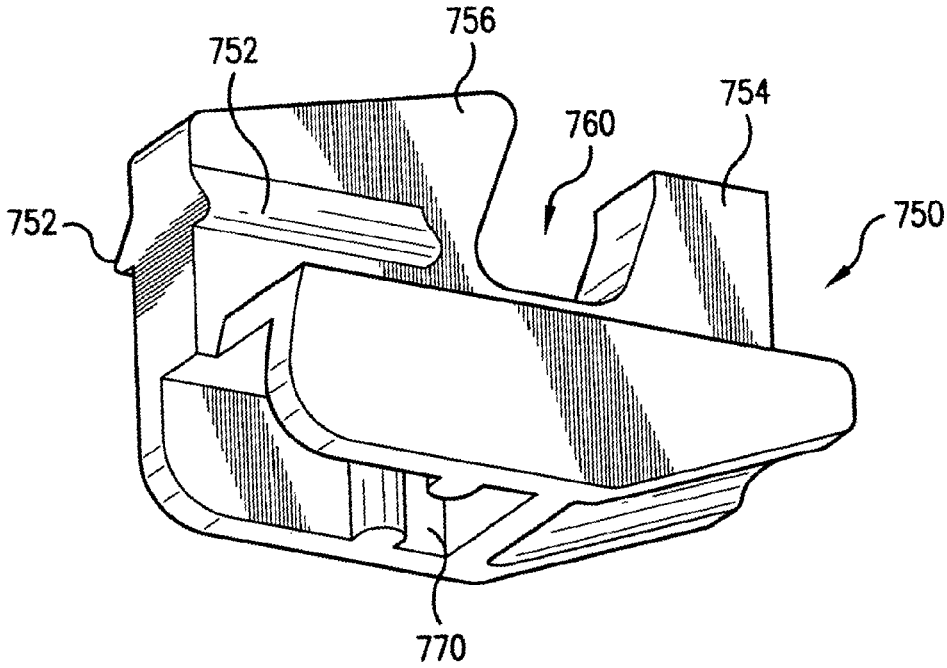
Figure 14A:
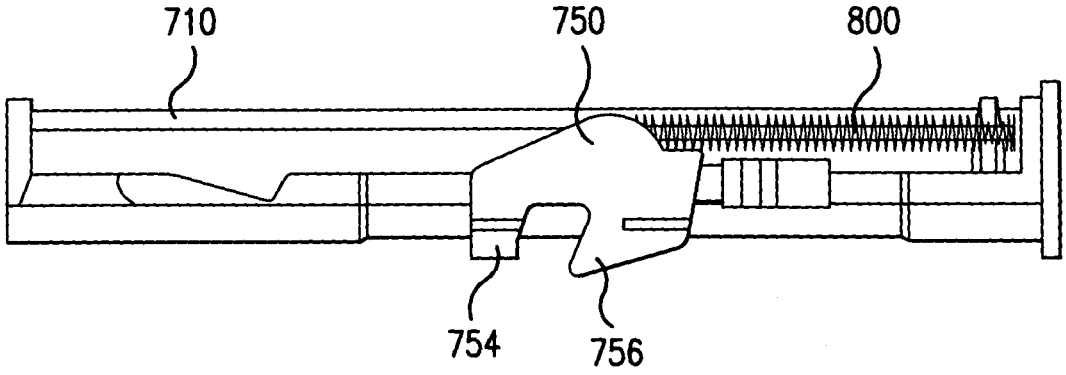
FIG. 14A is a side view of the closure mechanism shown in FIGS. 11A-11C.
Figure 14B:
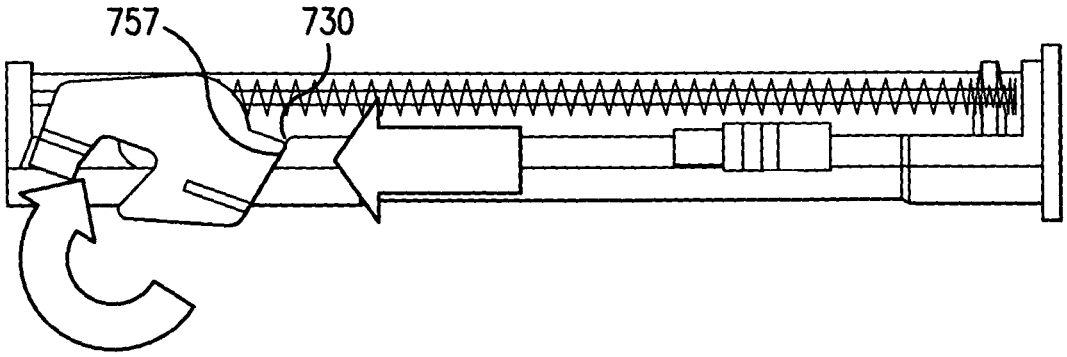
FIG. 14B shows the closure mechanism of FIG. 14A, with the carriage member in the latched position.
Figure 15A:
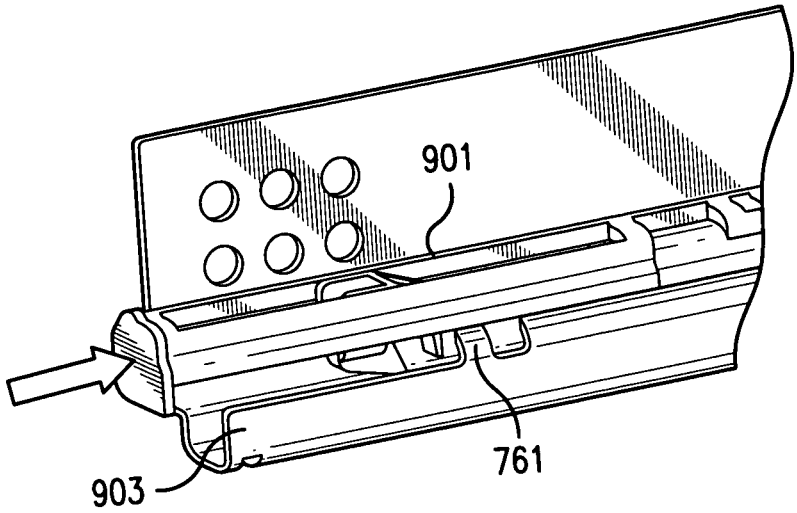
FIGS. 15A and 15B show perspective views of a closure mechanism installed bottom-side-up in a drawer member.
Figure 15B:
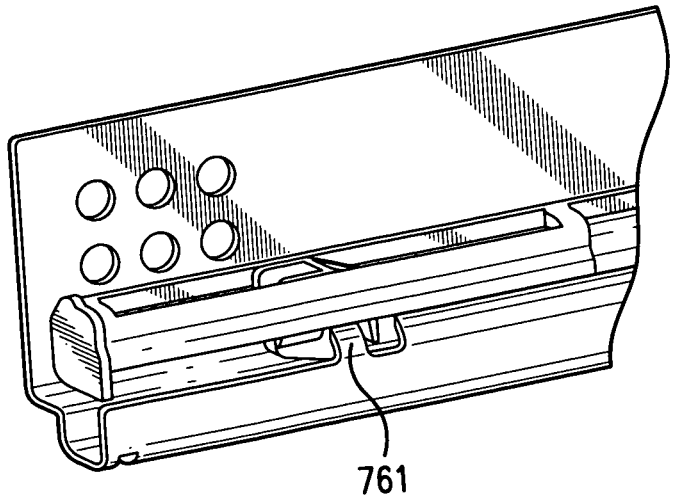

As shown in FIGS. 13A and 13B, the carriage 750 includes housing guides 752, as well as teeth 754, 756. The teeth, in turn, define a mouth 760 for engaging with a tab 761. On its bottom side, the carriage 750 includes a catch 770 for receiving and holding therein one end of the spring 800, whose opposite end is connected to a spring neck nest 720 at an end of the housing 710.

In an illustrative embodiment, the closure mechanism 700 may be coupled to an underside of a drawer member 901, such that the bottom side of the carriage 750 and the spring 800 face the drawer member's underside (i.e., bottom-side up). With this orientation, the tab 761 may then be coupled to, or integral with, the cabinet member 903. See, e.g., FIGS. 14A-15B. Of course, in alternative embodiments, the closure mechanism 700 may be coupled to the cabinet member, and the tab may be coupled to, or integral with, the drawer member.

In operation, and with reference to the illustrative example shown in FIGS. 14A-15B, the carriage 750 rides inside the housing 710, with the housing guides 752 keeping the carriage straight as it moves along the guide channel 712. As the drawer member 901 is extended away from the cabinet member 903, i.e., from right to left in FIGS. 14A-14B, the carriage 750 also moves in the same direction through the guide channel 712 via the engagement of the tab 761 with the mouth 760. As the carriage 750 approaches its fully extended position, i.e., the location of the recess 730, it begins to rotate under the tension force exerted by the spring 800.

Figure 11A:
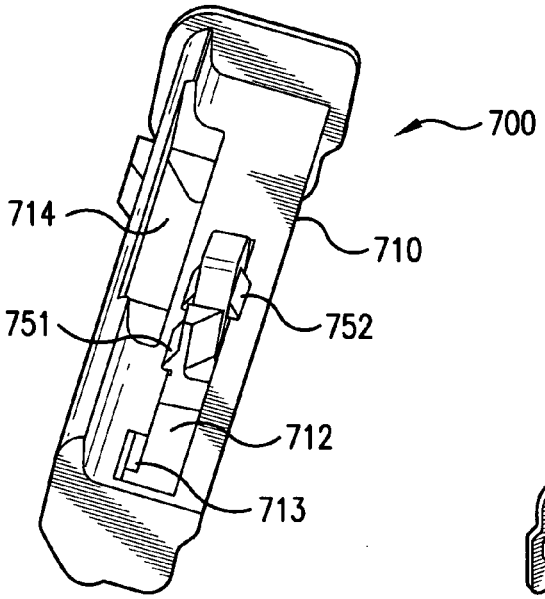
FIG. 11A is a perspective view of a top side of a closure mechanism in accordance with another embodiment of the invention.
Figure 11B:
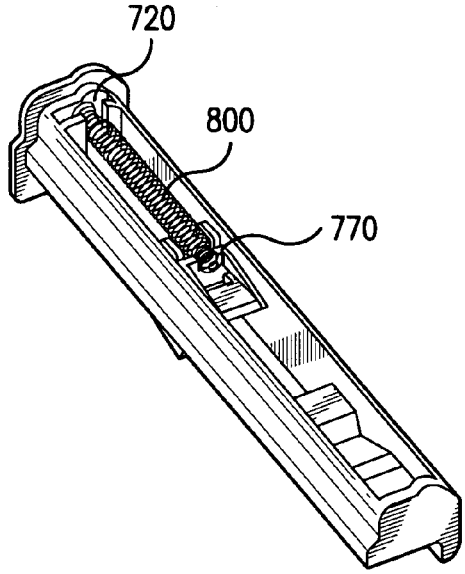
FIG. 11B is a perspective view of a bottom side of the closure mechanism shown in FIG. 11A, with the carriage member removed.
Figure 11C:
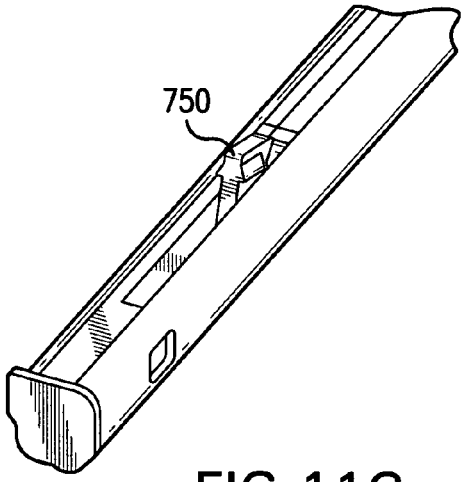
FIG. 11C is a perspective view of a top side of the closure mechanism shown in FIG. 11A, with the carriage member in a latched position.

With reference to, e.g., FIG. 11A, the carriage 750 also includes a ledge 751 that rides atop a sidewall of the guide channel 712 as the carriage moves along. In order to enable the carriage 750 to rotate as the fully extended position is approached, the guide channel 712 includes an indentation 713 to accommodate therethrough the ledge 751 as the carriage 750 rotates.

As the carriage continues to rotate, it allows the teeth 754, 756 to release the tab 761 from the mouth 760. At this point, the same rotational motion causes a locking edge 757 of the carriage to rotate downwards, thereby engaging the recess 730 of the housing base. In this way, as the drawer is extended further outwardly, the carriage remains latched, or locked, counteracting the spring tension and positioned to readily re-engage the tab 761 upon the drawer member's return towards the closed position. When the drawer member returns, the tab 761 pushes against the tooth 756 of the carriage, causing the carriage 750 to rotate which, in turn, releases the carriage from the latched position and allows the spring 800 to pull the drawer to full closure.

As with previous embodiments, in the event that the carriage 750 is inadvertently released from the latched position while the drawer member is in the open position, a resetting feature allows the closure mechanism to return to its normal operating mode. Specifically, with reference to FIGS. 13 and 15, at least one face 759 of the tooth 754 may be tapered so as to form a ramp section. This allows the tab 761 to force the carriage to move laterally out of the way as the drawer member 901 moves inwardly into the cabinet. This, in turn, causes the drawer member to be forced to the fully closed position, with the tab returning to its home position between the two teeth 754, 756, and ready to resume normal operation. It is noted that, in addition to helping in the installation process, the relief channel 714 also provides room for the carriage 750 to move laterally for purposes of the resetting feature discussed above.

The instant embodiment provides a configuration in which the guide channel for the carriage is in the same plane of motion as that of the drawer member, which provides for smoother motion. In addition, in an illustrative manufacturing process, the parts in the assembly may be created with an open and close injection mold, with the carriage snapping into place of the holder, which makes assembly a simple process. In this way, installation may involve a simple three step process as follows: First, the carriage is assembled onto the housing. The guide channel of the housing will spring open and accept the carriage. Once inserted, the carriage is fully contained and will only move along the direction of the guide channel. Next, the spring, with sufficient spring force to pull a drawer to full closure, is attached between the carriage and the housing. Finally, the whole assembly is inserted into the drawer member of the slide assembly.

In embodiments of the invention, the closure mechanism 700 may also include skirts, or flanges 715, 717 that extend from respective portions of a side wall of the housing 710. Specifically, as shown, for example, in the bottom view of FIG. 16A, flange 715 extends vertically from a side wall of the housing 710 at a position proximate the spring neck nest 720. Similarly, as shown in the top view of FIG. 16B, flange 717 extends vertically from the same side wall at a position proximate the indentation 713. Thus, as shown in FIGS. 16C and 16D, the flanges 715, 717 provide guidance and help maintain proper alignment between the cabinet member and the closure mechanism—and, therefore, the drawer member to which the closure mechanism is coupled in the illustrative example.

Figure 16A:
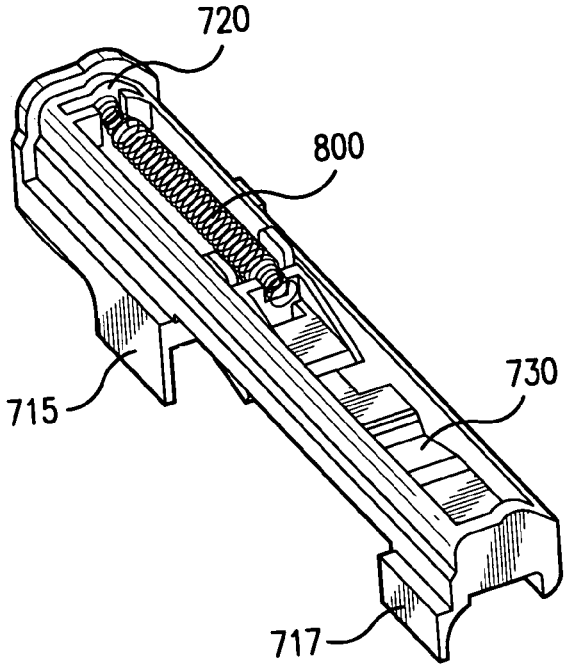
FIG. 16A is a perspective view of a bottom side of an alternative embodiment of the closure mechanism shown in FIGS. 11-12, with the carriage member removed.
Figure 16B:
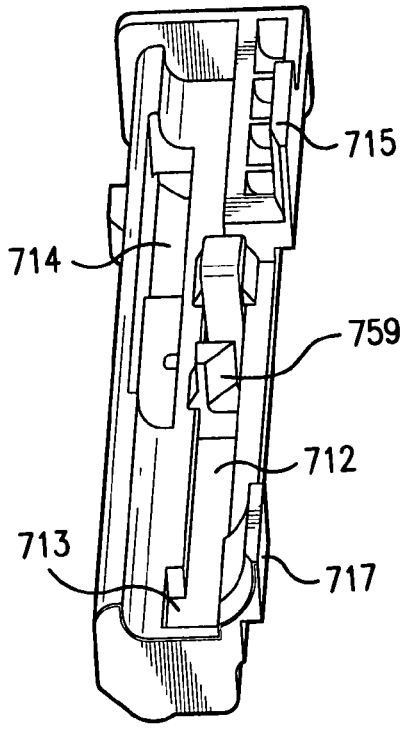
FIG. 16B is a perspective view of a top side of the closure mechanism shown in FIG. 16A.
Figure 16C:
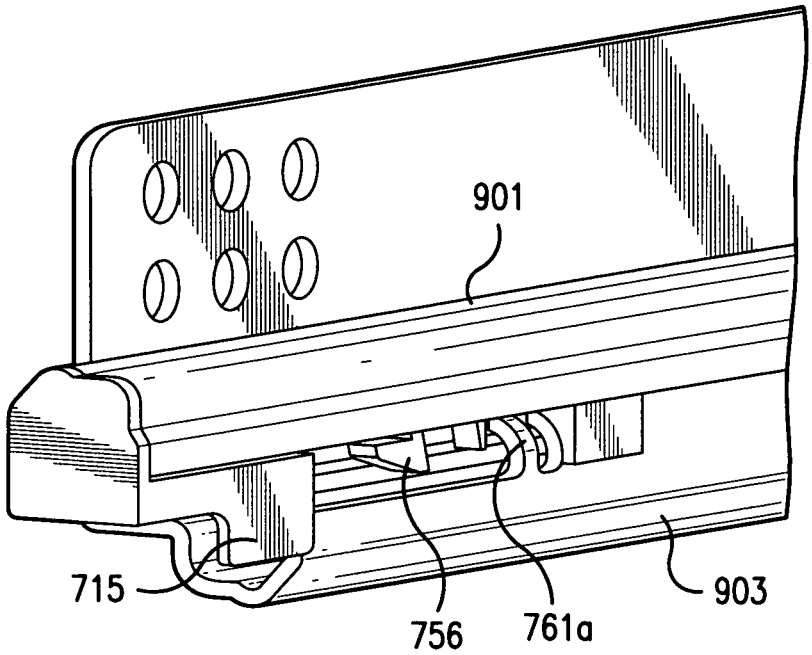
FIGS. 16C and 16D show perspective views of the closure mechanism shown in FIGS. 16A-16B installed bottom-side-up in a drawer member.
Figure 16D:
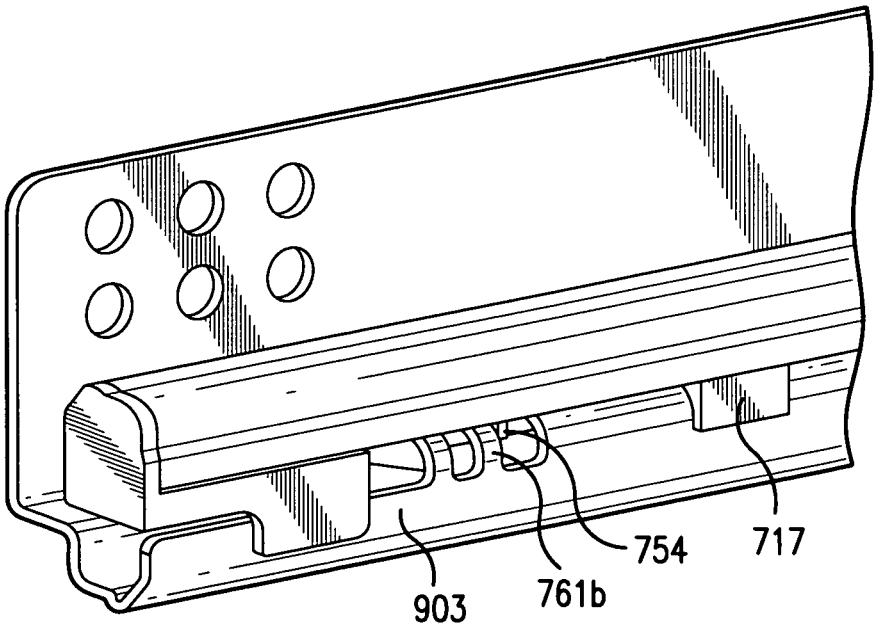

As shown in FIGS. 16C and 16D, in embodiments of the invention, the tab 761 may be constituted by a two-pronged structure having a first prong 761*a* and a second prong 761*b*. With reference to the resetting feature discussed above, the two-pronged structure allows the first prong 761*a* to force the carriage to move laterally out of the way as the drawer member 901 moves inwardly into the cabinet. This, in turn, causes the carriage to be re-engaged without requiring that the drawer member be fully closed. In the fully closed position, shown in FIG. 16D, both prongs of the tab are again disposed in the engagement area between the two teeth 754, 756.

It is noted that the inventions described herein may be used in various applications, such as, e.g., a drawer as part of an appliance, such as a refrigerator, or some piece of furniture, or toolbox, etc. In addition, it is understood that, while some of the aspects of the inventions have been described hereinabove with reference to only one side of a drawer-cabinet system, the same principles may be applied to the opposite side as well. Thus, for example, a closure mechanism 500, 600, and/or 700 may be used in conjunction with either the left, or the right, or both sides of a drawer/cabinet member.

While the description above refers to particular embodiments of the present invention, it will be understood that many modifications may be made without departing from the spirit and scope thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A self-closing drawer slide system comprising:

a first slide member;

a second slide member, said second slide member being slidable with respect to the first slide member; and a self-closing mechanism comprising:

a housing coupled to the first slide member, said housing having a front end, a rear end, and first and second parallel side walls extending between the housing's front and rear ends, wherein the first and second side walls include respective first and second longitudinal guide grooves, each of said guide grooves having a rotation zone proximate said front end, and a rectilinear portion extending rearwardly from the rotation zone, and wherein each said guide groove has a top edge and a bottom edge, said top and bottom edges being horizontal and parallel to each other in the rectilinear portion, and said bottom edge diverging from the horizontal top edge in the rotation zone;

a carriage slidably mounted between said first and second guide grooves and having a first guide ledge configured to slide along said first guide groove, and a second, opposing guide ledge configured to slide along said second guide groove, wherein the carriage is configured to engage with the second slide member and moves between a first, drawer-closed position in which the carriage is disposed towards a rear end of said rectilinear portion, and a second position in which the carriage is disposed in said rotation zone; and a single spring having a rear end coupled to said rear end of the housing, and a front end coupled to the carriage.

2. The drawer slide system of claim 1, wherein the first slide member is a cabinet member.

3. The drawer slide system of claim 1, wherein the second slide member includes a cam that engages the carriage.

4. The drawer slide system of claim 3, wherein, on a top side thereof, the carriage includes a pair of teeth defining an engagement area therebetween for receiving said cam.

5. The drawer slide system of claim 1, wherein, as the carriage moves from the first position towards the second position, the carriage is configured to rotate in the rotation zone and disengage from the second slide member.

6. The drawer slide system of claim 5, wherein the top edge of the first guide groove includes a first housing notch and the top edge of the second guide groove includes a matching second housing notch.

7. The drawer slide system of claim 6, wherein, once the carriage has fully rotated, a rear end of the carriage's first guide ledge is received in said first housing notch and a rear end of the carriage's second guide ledge is received in said second housing notch so as to latch the carriage in place.

8. The drawer slide system of claim 5, wherein the spring is biased in the drawer-closed position.

9. The drawer slide system of claim 1, further including a damping mechanism configured to dampen motion of the carriage.

10. The drawer slide system of claim 9, wherein the damping mechanism includes a damping rod, and the carriage includes a first catch for coupling to a front portion of said rod and a second catch for coupling to said front end of the spring.

11. The drawer slide system of claim 10, wherein said first catch is disposed on an underside of the carriage, and vertically above the second catch.

12. The drawer slide system of claim 1, wherein the first slide member is a cabinet member, the second slide member is a drawer member, and the system further includes a third slide member, said third slide member being an intermediate member that is slidably disposed between the cabinet and drawer members.

13. The drawer slide system of claim 12, wherein the cabinet member includes a substantially L-shaped connection portion and a lower rail member that is integral with the connection portion.

14. The drawer slide system of claim 12, further including first, second, and third balls disposed in raceways defined between a top portion of the intermediate member and the drawer member, wherein respective centers of said balls define corners of a first obtuse triangle.

15. The drawer slide system of claim 14, further including fourth, fifth, and sixth balls disposed in raceways defined between a bottom portion of the intermediate member and the cabinet member, wherein the respective centers of the fourth, fifth, and sixth balls define corners of a second obtuse triangle.

16. The drawer slide system of claim 15, wherein each of the first and second obtuse triangles includes one angle that is approximately 100°.

17. The drawer slide system of claim 16, wherein the intermediate member has a cross-section that is generally in the shape of an I-beam, with the vertical portion of the I-beam being generally in the shape of a reversed "S".

18. The drawer slide system of claim 1, wherein the first slide member is a cabinet member, the second slide member is a drawer member, and the system further includes a set of three balls disposed between the cabinet and drawer members such that the respective centers of the balls define corners of an obtuse triangle having one angle that is approximately 100°.

* * * * *